United States Patent [19]

Kuebler

[11] 4,182,512

[45] Jan. 8, 1980

[54] RACKET FOR PLAYING TENNIS OR SIMILAR BALL GAMES

[75] Inventor: Siegfried Kuebler, Uberlingen, Fed. Rep. of Germany

[73] Assignee: Kuebler & Co., Singen, Fed. Rep. of Germany

[21] Appl. No.: 725,363

[22] Filed: Sep. 22, 1976

[30] Foreign Application Priority Data

Dec. 3, 1975 [DE] Fed. Rep. of Germany ..... 2554267

[51] Int. Cl.[2] ..... A63B 49/04

[52] U.S. Cl. ..... 273/73 C

[58] Field of Search ..... 273/73 R, 73 C, 73 D, 273/73 F, 73 G, 73 H, 73 J, 170

[56] References Cited

U.S. PATENT DOCUMENTS

| | | | |
|---|---|---|---|
| 2,282,195 | 5/1942 | LeCompte | 273/73 C |
| 2,395,864 | 3/1946 | Geerlings et al. | 273/73 J |
| 3,130,762 | 4/1964 | Kerr | 273/170 X |
| 3,612,526 | 10/1971 | Brull | 273/73 G X |
| 3,702,701 | 11/1972 | Vaughn | 273/73 C X |
| 3,907,292 | 9/1975 | Moreland | 273/73 C |
| 3,913,911 | 10/1975 | Peterson | 273/73 C |
| 3,941,380 | 3/1976 | Lacoste | 273/73 G X |
| 4,057,250 | 11/1977 | Kuban | 273/73 G |

FOREIGN PATENT DOCUMENTS

| | | | |
|---|---|---|---|
| 15733 | 12/1933 | Australia | 273/73 J |
| 2106800 | 9/1971 | Fed. Rep. of Germany | 273/73 C |
| 2224316 | 11/1973 | Fed. Rep. of Germany | 273/73 G |
| 2221161 | 10/1974 | France | 273/73 C |
| 174550 | 2/1922 | United Kingdom | 273/73 J |

*Primary Examiner*—Richard J. Apley

*Attorney, Agent, or Firm*—Hane, Roberts, Spiecens & Cohen

[57] ABSTRACT

A racket for playing tennis or similar ball games has a frame or head portion mounting the web of strings and of generally oval or elliptical configuration and a straight handle co-axial with the major axis of the frame. The frame includes at the lengthwise sides of the frame, that is, adjacent to the minor axis of the frame, spaces within the frame material or in containers attached to said frame sides a plurality of granules such as pellets which are freely movable within said spaces if and when the racket is swung to hit a ball, thereby damping vibrations as are generated when the ball impacts upon the web mounted on the frame. Similar spaces can also be provided in the yoke of the racket and partly filled with pellets also causing damping the vibrations generated by the impact of the ball.

10 Claims, 10 Drawing Figures

RACKET FOR PLAYING TENNIS OR SIMILAR BALL GAMES

The invention relates to a racket for playing tennis or similar ball games, and more particularly to a racket having a generally ovally or elliptically shaped frame portion for mounting a web formed of tautly strung guts or synthetic plastic strings and a straight handle terminating in a grip portion disposed coaxial with the major axis of the frame portion.

BACKGROUND

With rackets of the general type above referred to, the racket is generally selected by a customer in accordance with his physical capabilities, and particularly with respect to the shape and weight of the grip portion. Theory and practical experience show that this manner of selecting a racket is costly for the manufacturer and the store offering rackets for sale as a great number of rackets having differently shaped and weighed grips must be kept in the inventory.

THE INVENTION

It is a broad object of the invention to provide a novel and improved racket of the general type above referred to which permits convenient adjustment of the weight distribution and thus of the power distribution in accordance with the physical conditions of the potential purchaser of a racket.

A further broad object of the invention is to provide a novel and improved racket of the general type above referred to which reduces or even eliminates the rather frequent and often painful occurrence of a so-called "tennis arm" or "tennis elbow" suffered by the player.

As it is known, when a ball is hit vibrations having an irregular frequency spectrum are generated. These frequencies are transmitted via the frame of the racket to the respective arm of the player. Depending upon the tautness of the web and the material of which the web and the frame of the racket and also the handle are made, the vibrations are more or less damped. In this connection it is of little importance whether the frame is made of several sandwiched layers, metal or synthetic material reinforced by fibers. Powerful occurring vibrations or frequencies carried into the arm of the player may result in fatigue of the arm and such fatigue tends to cause inflammation of the tendons and muscle strain.

Accordingly, it is also an object of the invention to obtain a highly effective damping of the frame to eliminate or deflect vibrations as much as possible at the location of generation.

To avoid or at least reduce the afore-referred to vibrations and/or frequencies, several technical possibilities are available or at least proposed. The best known are hereinafter listed:

(a) Bending of the racket and twisting density thereof are used to effect damping of the vibrations. By a flat or slim rand portion between the yoke and the grip damping of the frequency can be influenced. However, it is disadvantageous that such damping action acts only upon a limited frequency band, that is, the damping is inherently selective.

(b) Conduction of the vibrations is impeded by a hammer or a tuning fork type member provided at the grip portions of the racket. However, this type of damping also produces only a selected damping, that is, damping within a limited frequency band.

(c) Mounting of special damping layers on the frame. It has been found that large damping masses are necessary to obtain a noticeable damping effect. Hence, this method of damping is not practical.

(d) The use of a sandwich-type method by using materials of very high strength alternately with homogeneous damping layers. This type of damping produces for reasons of physics only a selective damping within a limited and never very large frequency range.

The inventor has carefully examined all the aforementioned means of damping and reached the conclusion that they are not sufficiently successful.

Applicant has conceived and tested a novel and improved construction of a racket which automatically reduces the afore-discussed potentially harmful vibrations generated in and by a racket when swung for hitting a ball. According to the invention, there are provided within the racket or attached thereto, and particularly within the frame of the racket closed spaces which are at least partly filled with a granulated material, that is pellets, which are freely movable substantially normal to the direction of the minor axis of the racket frame within the limits set by the aforementioned spaces. Preferably the granulated material has a high specific weight. Granules or pellets may be lead or steel pellets of approximately the type which are used in shells fired from shot guns.

Another advantage of small granules or pellets is that any desired quantity can be easily introduced into the spaces within or at the frame. This possibility of conveniently selecting the used quantity of the pellets makes it simple to adjust the racket to the specific requirements of an individual player.

It is also of importance that on the basis of the aforeindicated use of pellets the energy changes as they occur when the racket is swung can be adjusted so that the movable pellets can be selected so that impact action is improved, or in other words that the force of a swing is considerably increased, in contrast to rackets as they are now used to increase the impact force without changing the force applied by the player. In other words, the force applied to a ball impacting upon the racket is absorbed without requiring great strength on the part of the player.

Applicant, when and while developing a racket according to the invention, is utilizing the loss of energy as much as possible. Such full utilization of the laws of energy has been obtained by placing the granules such as steel pellets with play in a closed chamber provided either directly within the frame or in a casing attached thereto.

Preferably the granulated material is placed according to another feature of the invention in boxes or casings attached to the frame if preferred so that they can be easily released.

According to still another feature of the invention the yoke of the racket is provided with one or more closed cavities at least partly filled with granulated material such as pellets. The inventor has also found that a particularly good mounting of such yoke is obtained by providing on the yoke itself and the adjacent frame and/or handle portions stubs and holds which are engageable with each other.

A particularly advantageous distribution of the weight of the racket is obtained when the frame is partly hollow and the hollow parts are partly filled with granules which are freely movable along the length of the hollow space within the frame, and particularly in the areas of the hollow space adjacent to the minor axis of the frame.

According to still another aspect of the invention, the spaces or cavities in the frame are preferably divided by partition walls into several separate spaces all of which or alternate ones are partly filled with granulated freely movable material. Preferably, the subdivision of the space in the frame can be effected by strips which are slipped into the frame, and more specifically, in crosswise direction thereby permitting to select the number and locations of individual chambers.

By filling dry, form-retaining granulated material such as sand, steel or lead into the spaces within the frame, especially through holes if the racket is made of a suitable metal such as a lightweight metal—for instance aluminum—these holes can then be closed by the aforementioned strips or other covering material. Such arrangement permits adaptation of the weight distribution within the frame to the specific capabilities of the player using the racket. The same purpose can be achieved by using boxes or casings which are detachably secured to the racket and particularly to lengthwise portions of the frame.

The desired damping of vibrations is at a maximum if the used granulated material such as pellets are provided at portions of the racket which are subjected to large movements when the racket is used during play, that is, in or adjacent to the minor axis of the frame. The vibrations are damped or even completely eliminated in the directions of the major axis and also the minor axis of the frame in contrast to damping systems as they are now known. The extent of the damping is controlled at least to a considerable extent by the ratio of the mass of pellets relative to the frame. It has been found that the generated frequencies or vibrations are uniformly and considerably reduced. However, it is essential that the used granules are neither wet nor subjected to spring or other pressure, that is, they must be freely movable relative to each other so that they can easily move within the limits of the available space when the racket is swung one way or the other during play.

It is a further object of the invention to arrange the individual chambers side-by-side usually in lengthwise direction as such arrangement increases the desired damping action. When the rapidity of movement of the player is increased as it may occur when a ball to be returned is hit, the damping is available when it is most needed, namely at the moment of a high amplitude or high acceleration of the moments to which the racket is subjected. When the racket is swung forwardly, the granules or pellets in the chambers will automatically move rearwardly within the frame, that is, the wall surface constituting the rearward surface relative to the top of the frame. At the moment of the impact of the ball on the racket the granules or pellets are propelled forwardly thereby transferring the inherent energy of the pellets to the opposite wall surface, that is, the surface nearer to the top.

There are known rackets, for instance from U.S. Pat. No. 3,907,292, which disclose a racket substantially the entire length of which, that is, the frame or head portion and the handle, are provided with a continuous tube-like space. This space is partly filled with pellets. There are provided within the tubular space coil springs which when in the relaxed position retain the pellets in positions removed from the top part of the head or frame portion or in the lower part of the handle. However, if the racket is rapidly swung, the centrifugal force now acting upon the pellets cause the same to compress the springs and thus to move closer toward the top portion of the frame or the upper part of the handle than they were when the springs were relaxed. Such an arrangement changes the weight distributions of the frame by moving it toward the top of the frame thereby increasing the power with which the racket will impact upon the ball as is also the purpose of this arrangement, but it will not produce the uniform and powerful damping as attained with the arrangement according to the present invention.

BRIEF DESCRIPTION OF THE DRAWING FIGURES

In the accompanying drawing several embodiments of the invention are shown by way of illustration and not by way of limitation.

DETAILED DESCRIPTION OF THE DRAWING

Figure 1:
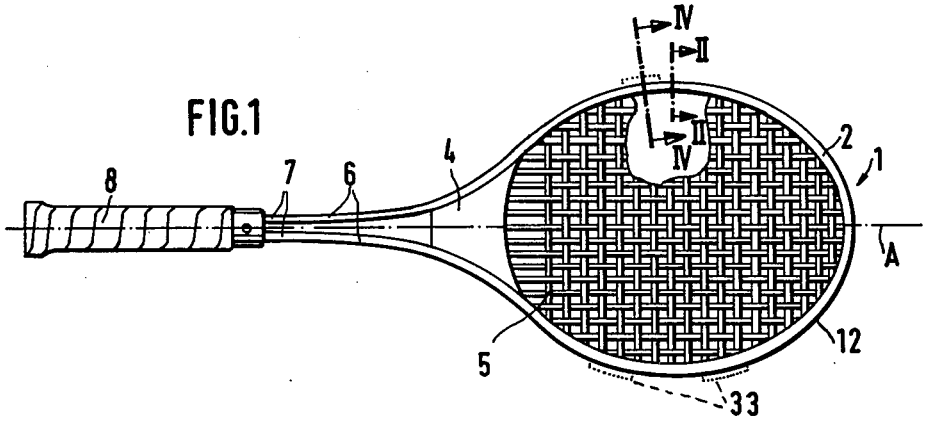
FIG. 1 is a plan view of a tennis racket according to the invention.

FIG. 1 shows a tennis racket 1 which comprises a frame or head portion 2 of generally oval or elliptical configuration. The frame 2 may be formed of a hollow or tubular rod 3 which is shaped so as to form the oval or elliptical shape of the frame. The frame is continued by a straight handle 7 terminating in a grip 8 of generally conventional design. The handle and the grip are disposed coaxially with the lengthwise or major axis A of the frame. At the ends of the rod forming the frame, a yoke 4 is fitted and suitably secured between the frame and the handle to strengthen the frame and the entire racket.

The frame is strung in a conventional manner to form a taut web 5 consisting of strings for instance of gut or suitable synthetic plastics material.

Figure 2:
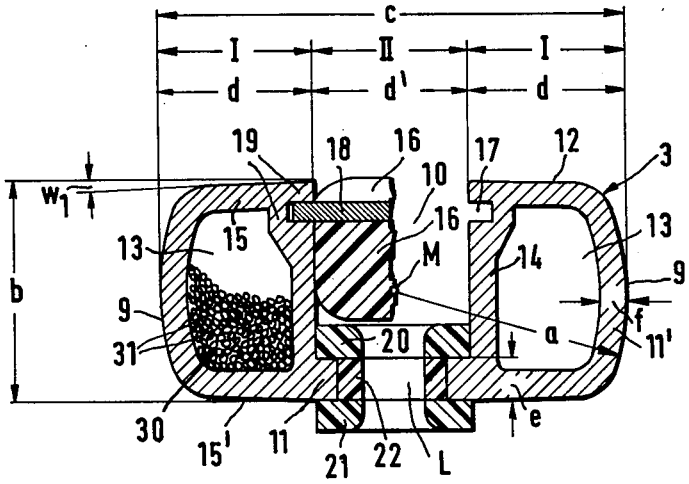
FIG. 2 is a section taken along line II—II on an enlarged scale.

Referring now to FIG. 2, rod 3 is shown as having an essentially rectangular cross section with preferably slightly curved side walls 9. The radius a of sides 9 relative to the center point M is slightly larger than the height b of the rod. The entire width c of the rod is divided into three zones I, II, I, which have approximately the same width d and d', respectively. The middle zone (II) forms a crosswise substantially square channel 10. The wall portion defining the central zone includes bores L for the strings 5 which are secured within the bottom wall 11. The thickness e of wall 11 is on the inner side of the frame when and while the rod is being installed, that is, the channel 10 is open towards the outside 12 of the tennis racket 1.

The two outer zones I which sandwich the middle zone II include each a space 13 which is surrounded by a wall 11' and thus forms spaces which are parallel to the lengthwise axis F of the hollow rod 3 forming the frame.

The lateral walls 14 of the channel 10 are provided near the lengthwise side 15 of the hollow rod 3 with elongate grooves 17 for insertion of a strip 18 or a similar cover member.

Instead of a continuous strip shaped insert 18, short crosswise strips can also be provided spaced from each other and inserted into the grooves 17 as it is shown in FIG. 2. These strips serve to hold an elastic filler material for the channel 10, for instance a rubber block 16. Within the reach of the lengthwise groove 17 the side walls 14 have reinforcements 19 as are necessary when strips 18 are used.

A strip 20 made of a suitable synthetic plastics material such as polyamide is inserted into the channel 10. The width of the strip 20 is approximately equal to the width of channel 10. The strip 20 is connected by the cylindrical cases or partition walls 22 which are fitted into bores L and line the same which covers the outside 15' and is made of the same synthetic material. The plastic strips 20, 21 are, for instance, heat sealed to the intermediate pieces 22. Each space 13 is partly filled with granulated material 30, for instance, with small pellets or spheres 31 made of hard lead having a diameter between one and six millimeters. Pellets or spheres of this size are readily available as they are widely used in shells for shotguns.

Figure 3:
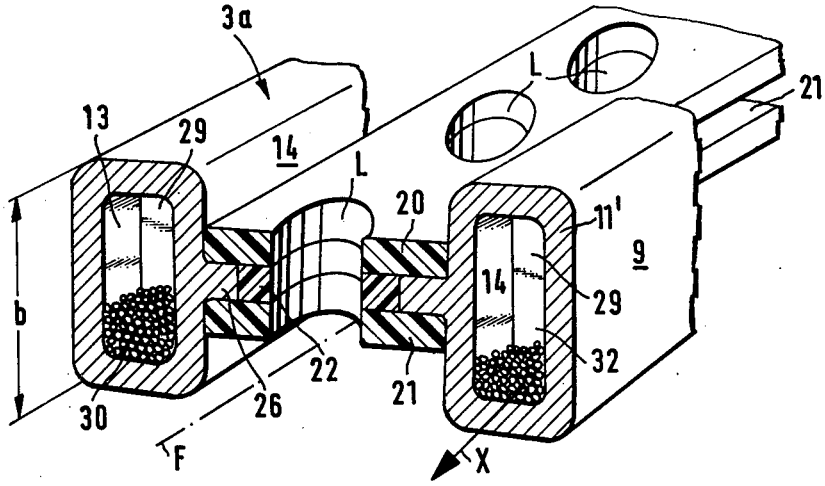
FIG. 3 is a perspective view of a cross section of another embodiment of the invention, assumed to be a cross section of the frame taken along line II—II also.

FIG. 3 shows a hollow rod 3 with a web 26 located in the middle of the height b of the rod. Strips 20 and 21 of plastic material abut against both surfaces of the web and engage intermediate pieces 22 which extend through bores L. Spaces 13 within the rod 3 are subdivided by partition walls 29 into several chambers or spaces 32 which are partly filled with granulated material 30.

Figure 4:
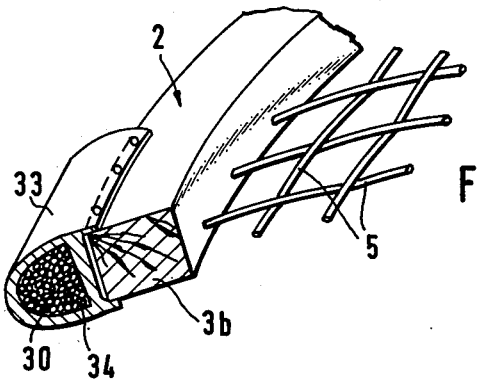
FIG. 4 is another modification of the structure of the invention presumed to be taken on line IV—IV of FIG. 1 and showing the structure on an enlarged scale.

In FIG. 4 a further embodiment of a tennis racket according to the invention is shown. According to this Figure, short boxes or casings 33 are secured to a solid frame 3*b*. The positions of the casings are indicated in FIG. 1 by dotted lines also designated 33.

The cavity or space 34 within these boxes or casings, which are preferably detachably secured to the frame 2, are filled at least partly with granulated material 30.

Figure 5:
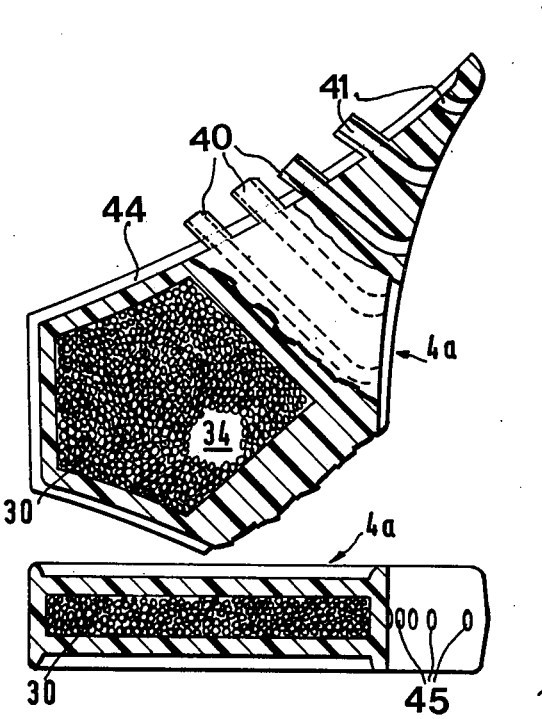
FIG. 5 shows a lengthwise section and a cross section of a further modification of the invention applied to the yoke of the racket.

According to FIG. 5, the granulate 30 is filled in another modification according to the invention into a cavity 34 within a yoke 4. The yoke 4 has curved sides 44 which constitute the outer sides thereof when the yoke is mounted adjacent to the free ends 6 of rod 3. These curved side walls 44 are disposed on both sides of the center axis A. Each side or outer wall has five bores 41 extending to the inside of yoke 4. Bores 41 occupy within the range of the sides 44 an angle of about 45° relative to the center axis A and are continued near the center side of the frame with exit openings 45 which are disposed approximately parallel to the center axis A.

As it appears from the section of the yoke, also shown in FIG. 5, the sides 44 mount lugs 40 which are inserted into the corresponding bores (not shown) in rod 3, thereby securing the yoke to the frame proper. Of course, there may also be bores in the yoke and engaging lugs on the frame.

Figure 6:
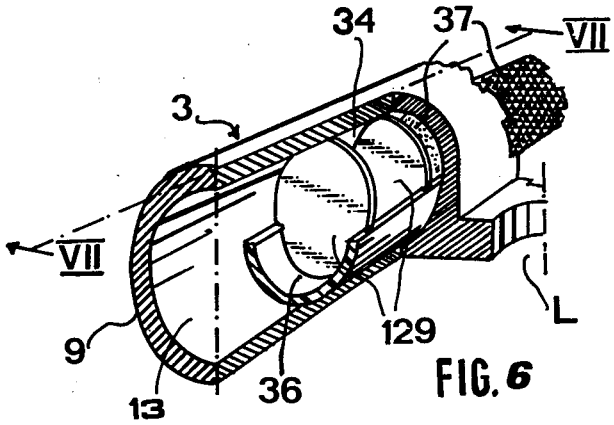
FIG. 6 is a perspective view, partly in section, of a still further modification of the structure according to the invention applied to a lengthwise portion of the frame.
Figure 7:
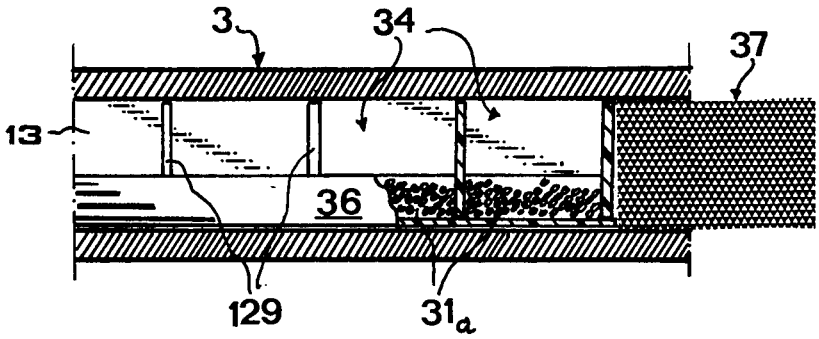
FIG. 7 is a section taken on line VII—VII of FIG. 6.

To form the chambers or spaces 34 for selected quantities of granulate 31*a*, there are provided according to FIGS. 6 and 7 within the space 13 in rod 3 rib forming strips 36. The outer side of these strips fits the inner wall surface of rod 3. Moreover, strips 36 support and hold in position crosswise discs 129 which thus form partition walls separating the individual chambers or spaces 34.

The strip inserts 36 which are preferably made of somewhat flexible material such as a suitable synthetic plastics material can be extended over the entire length of the spaces or chambers 13. However, for manufacturing reasons, there can also be provided short insert strips 36 which alternate with lightweight filler material 37, such as styrofoam.

While the invention has been described in detail with respect to certain now preferred examples and embodiments of the invention, it will be understood by those skilled in the art, after understanding the invention, that various changes and modifications may be made without departing from the spirit and scope of the invention, and it is intended, therefore, to cover all such changes and modifications in the appended claims.

I claim:

1. A racket for playing tennis and similar ball games, said racket comprising: a frame for mounting a web of strings, said frame being of generally oval configuration having a major and a minor axis, a straight handle extending from one lengthwise end of said frame, the major axis of the frame and the center axis of the handle defining a common axis, lengthwise frame portions substantially parallel to said common axis having at least one chamber of reduced size compared to said frame portions on both sides of said common axis; and a multitude of granules freely movable relative to each other partly filling said chambers, said granules being of substantially smaller size than the chamber to enable said granules to move relative to one another and to said chamber in all directions, the crosswise and lengthwise widths of said chambers and the quantity of granules therein being so correlated that the granules in response to swinging of the racket are activated and propelled substantially crosswise to said common axis within the limits of the widths of said chambers thereby damping vibrations and frequencies generated in the frame and the handle by abrupt swinging of the racket and/or the impact of a ball on the web in the frame, said frame comprising two parallel ovally curved hollow rods and means joining said rods in parallel but crosswise spaced relationship, each of said rods including said at least one said chamber partly filled with said granules in said lengthwise frame portions substantially parallel to said common axis, and filler means disposed between said rods for engaging said strings between said rods, said joining means including means for securing said filler means to the frame.

2. The racket according to claim 1 wherein said granules are substantially spherical pellets.

3. The racket according to claim 1 wherein said granules are metal pellets.

4. The racket according to claim 1 wherein said chambers are in the form of closed holes within the lengthwise sides of the frame.

5. The racket according to claim 1 wherein a yoke is fitted between the frame and the handle and joining the handle to the frame, said yoke including a closed cavity, said cavity being partly filled with said granules.

6. The racket according to claim 1 comprising lengthwise spaced crosswise partition walls dividing the space in the hollow rod into several chambers, each of said chambers being partly filled with granules.

7. The racket according to claim 6 wherein said partition walls and the chambers defined by the same are disposed on the lengthwise sides of the frame.

8. The racket according to claim 1 comprising a metal tube shaped to form said oval frame including the chambers at least partly filled with granules, said handle and a yoke fitted in open space left by the tube at the transition from the curved tube portions defining the frame to the tube portions defining the straight handle, the edge walls of the yoke and the juxtaposed tube portions having respective lugs and holes engageable with each other for securing the yoke to the frame and handle.

9. The racket according to claim 8 wherein said yoke includes at least one closed cavity partly filled with freely movable granules.

10. The racket according to claim 1 wherein said handle terminates at its free end in an elongate grip portion, said grip portion including a hollow space at least partly filled with granules.

* * * * *